US008556595B2

(12) United States Patent
Armstrong

(10) Patent No.: US 8,556,595 B2
(45) Date of Patent: Oct. 15, 2013

(54) PUMP ASSEMBLY FOR EVAPORATIVE COOLER

(76) Inventor: Karl Armstrong, El Paso, TX (US)

( * ) Notice: Subject to any disclaimer, the term of this patent is extended or adjusted under 35 U.S.C. 154(b) by 304 days.

(21) Appl. No.: 12/762,599

(22) Filed: Apr. 19, 2010

(65) Prior Publication Data

US 2011/0189037 A1 Aug. 4, 2011

Related U.S. Application Data

(60) Provisional application No. 61/214,801, filed on Apr. 18, 2009.

(51) Int. Cl.
*F04B 23/14* (2006.01)

(52) U.S. Cl.
USPC ..... 417/201

(58) Field of Classification Search
USPC ..... 417/201, 423.1, 313; 62/121, 171, 62/259.4, 304
See application file for complete search history.

(56) References Cited

U.S. PATENT DOCUMENTS 1,370,422 A * 3/1921 Funk et al. ..... 384/373
5,003,789 A * 4/1991 Gaona et al. ..... 62/304
5,006,282 A * 4/1991 Butcher ..... 261/29
5,275,538 A * 1/1994 Paliwoda et al. ..... 417/314
5,975,846 A * 11/1999 Wistinghausen ..... 415/206
6,613,182 B1 * 9/2003 Calvert ..... 156/292
6,786,701 B1 * 9/2004 Huang et al. ..... 417/199.1
7,424,907 B2 * 9/2008 Chou et al. ..... 165/80.4
7,806,388 B2 * 10/2010 Junkel et al. ..... 261/28
8,016,270 B2 * 9/2011 Chen et al. ..... 261/28
2003/0221441 A1 * 12/2003 Hong ..... 62/314
2008/0019850 A1 * 1/2008 Tajima et al. ..... 417/410.1
2009/0050082 A1 * 2/2009 Iwasaki ..... 123/41.49

* cited by examiner

*Primary Examiner* — Devon Kramer
*Assistant Examiner* — Christopher Maxey
(74) *Attorney, Agent, or Firm* — L.C. Begin & Associates, PLLC

(57) ABSTRACT

A pump assembly for circulating water in an evaporative cooler is provided. The pump assembly may include a housing which defines a cavity. The pump assembly may also include an impeller received in the cavity of the housing. Further, the pump assembly may include a rod which may be operatively associated with the impeller and extends out of the housing. Moreover, the pump assembly may include a connecting member which is operatively associated with the rod, and may be adapted to be operatively associated with a shaft of a fan assembly incorporated into the evaporative cooler. The connecting member may be adapted to transmit rotary motion of the shaft to the impeller, thereby enabling the pump assembly to circulate water in the evaporative cooler.

8 Claims, 3 Drawing Sheets

PUMP ASSEMBLY FOR EVAPORATIVE COOLER

CROSS REFERENCE TO RELATED APPLICATION

This application claims the benefit of U.S. Provisional Application No. 61/214,801 filed on Apr. 18, 2009, the disclosure of which is incorporated by reference.

FIELD OF THE INVENTION

The present disclosure generally relates to pump arrangements, and, more particularly to a pump assembly adapted for circulating water in an evaporative cooling unit.

BACKGROUND OF THE INVENTION

Use of evaporative cooling units (also known as swamp coolers) for comfort in hot weather is known. A swamp cooler generally includes a box-like body having a tank carried by a bottom portion of the body. The tank may be used to store water. Further, a water circulating pump may be submerged in the tank. During operation, the water circulating pump may circulate water through pipes onto fibrous pads mounted on sides of the swamp cooler's body. A fan assembly may also be mounted within the body and adapted for blowing air for delivering cool air out of the swamp cooler.

The submerged water circulating pump of the swamp cooler may be electrically connected to a power outlet using an electrical wire. This may create a potential fire hazard during operation of the swamp cooler. Specifically, prolonged use of the swamp cooler may damage the wire, leading to short circuit causing a fire. Additionally, performing repair or maintenance work on swamp coolers that have damaged electrical wires connected to the pump may also be a potential threat for workers doing the repair or maintenance work.

SUMMARY OF THE INVENTION

In accordance with one aspect of the present invention, a pump assembly is provided for circulating water in a swamp cooler having a fan assembly associated with a shaft. The pump assembly may include a housing which may include a cavity. The pump assembly may also include an impeller adapted to be received in the cavity. Further, the pump assembly may include a rod which may be operatively associated with the impeller and extends out of the housing. Moreover, the pump assembly may include a connecting member which may be operatively associated with the rod, and may be adapted to be operatively associated with the shaft of the fan assembly. The connecting member may be adapted to transmit a rotary motion of the shaft to the impeller, thereby enabling the pump assembly to circulate water in the swamp cooler.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION

The exemplary embodiments described herein detail for illustrative purposes are subject to many variations in structure and design. It should be emphasized, however, that the present disclosure is not limited to a particular pump assembly for a swamp cooler as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms, "first," "second," and the like, herein do not denote any order, elevation or importance, but rather are used to distinguish one element with another. Further, the terms, "a" and "an" herein do not denote a limitation of quantity, but rather denote the presence of at least one of the referenced item.

The present disclosure may provide a pump assembly capable of circulating water in an evaporative cooling unit. The pump assembly of the present disclosure may preclude a need of having an electrical supply for its operation. Therefore, the pump assembly may preclude a need of having electric wires for the operation thereof.

Figure 1:
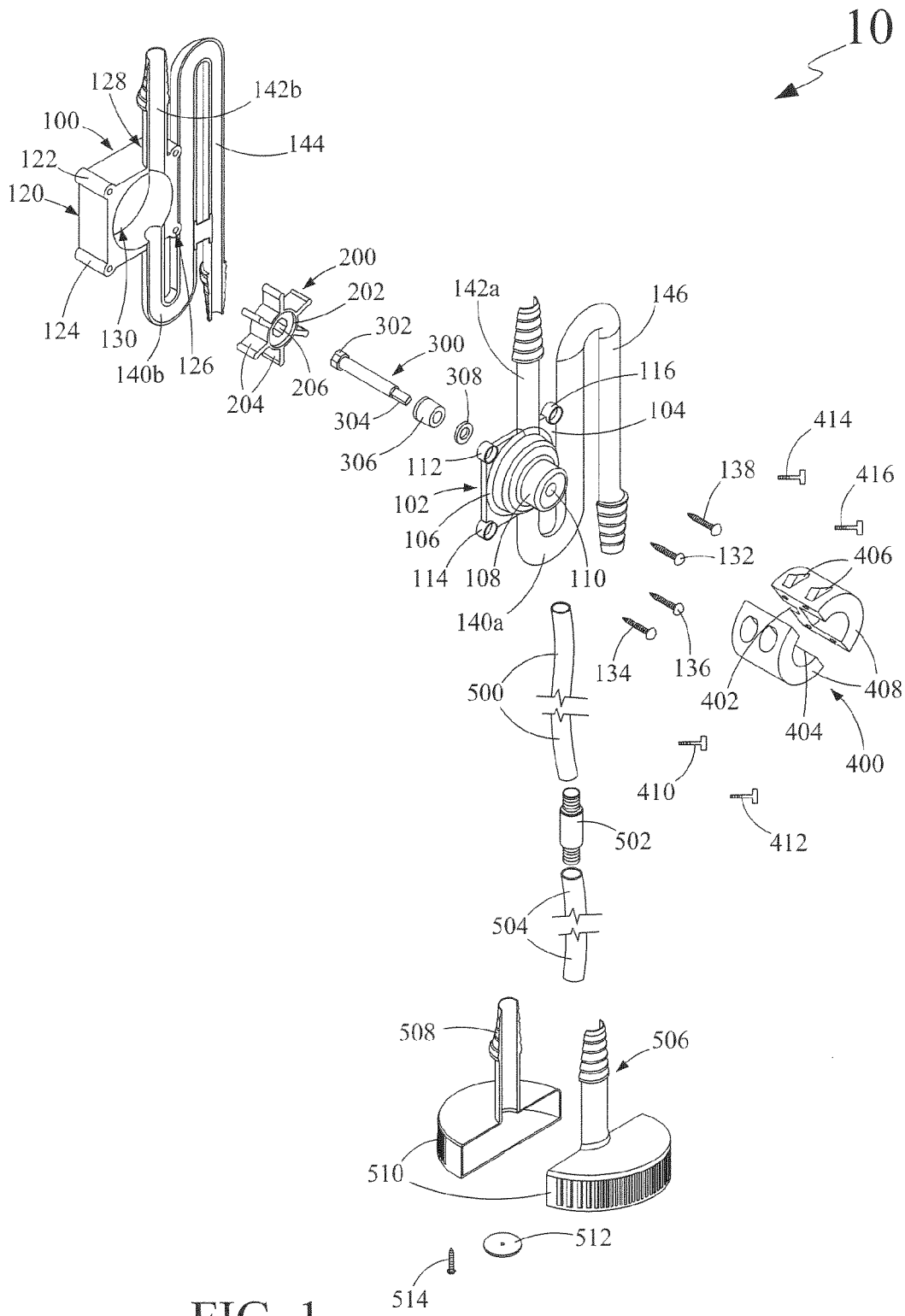
FIG. 1 is an exploded perspective view of a pump assembly in accordance with one embodiment of the present invention.

Referring to FIG. 1, a pump assembly 10 may include a housing 100. The housing 100 may include a first half casing 102. The first half casing 102 may include a plate member 104 having a rectangular shape. Alternatively, the plate member 104 may have any of a variety of other shapes such as, but not limited to, a circular shape or a polygonal shape. The first half casing 102 may also include protruding portions 106 and 108 extending centrally from the plate member 104. The protruding portion 106 may have a hollow cylindrical shape. Further, the protruding portion 108 may have a cylindrical shape. Portions 106 and 108 may be substantially coaxial. Furthermore, the protruding portion 108 may include a hole 110 extending centrally along a length thereof. Moreover, the first half casing 102 may include rounded flanges 112, 114, and 116 (shown in FIG. 1) and 117 (not shown in FIG. 1) carried by corners of the plate member 104. Each of the rounded flanges 112, 114, and 116, and 117 may include an opening extending therethrough.

The housing 100 may also include a second half casing 120. The second half casing 120 may have a rectangular shape, which may conform to the shape of the plate member 104. Alternatively, the second half casing 120 may have any of a variety of other shapes, such as a circular shape or a polygonal shape, conforming to the shape of the plate member 104. Further, the second half casing 120 may also include rounded flanges 122, 124, 126 and 128 carried by corners of the second half casing 120. Each of the rounded flanges 122, 124, 126 and 128 may include a threaded opening extending therethrough.

The first half casing 102 and the second half casing 120 may be coupled to each other for configuring a cavity 130 therebetween. Specifically, the hollow interior of the protruding portion 106 and the interior of the second half casing 120 may define the cavity 130 between the first half casing 102 and the second half casing 120. The first half casing 102 and the second half casing 120 may be coupled to each other with a plurality of screws 132, 134, 136, and 138. Alternatively, the first half casing 102 or the second half casing 120 may include a plurality of protruding members and an associated plurality of slots, configured at peripheries thereof, enabling snap fit coupling between the first half casing 102 and the second half casing 120. Alternatively, the first half casing 102 and the second half casing 120 may be coupled together using any other suitable means, for example, adhesive attachment, an interference fit, or ultrasonic welding.

The pump assembly 10 may include an inlet port 140 operatively coupled to housing 100. In the embodiment shown in the drawings, a portion 140*a* of the first half casing 102 extends from a lower part of the first half casing to form one portion of inlet port 140, and a portion 140*b* of the second half casing 120 extends from a lower part of the second half casing to form another portion of inlet port 140. These two portions 140*a* and 140*b* of the half casings 102 and 120 combine to form the inlet port 140 when the half casings 102 and 120 are secured to each other. Each of inlet port portions 140*a* and 140*b* may be molded, cast, or otherwise formed as an integral part of a respective one of the first half casing 102 and the second half casing 120. Alternatively, the inlet port 140 may be a separate component, which may be adapted to be coupled to one or both of the first half casing 102 and the second half casing 120 so as to enable fluid communication between an exterior of housing 100 and cavity 130. In a particular embodiment, the inlet port 140 is a separate component received between the first half casing 102 and the second half casing 120, such that, when the first half casing 102 and the second half casing 120 are coupled to each other the inlet port 140 may be securely held therebetween.

Figure 2:
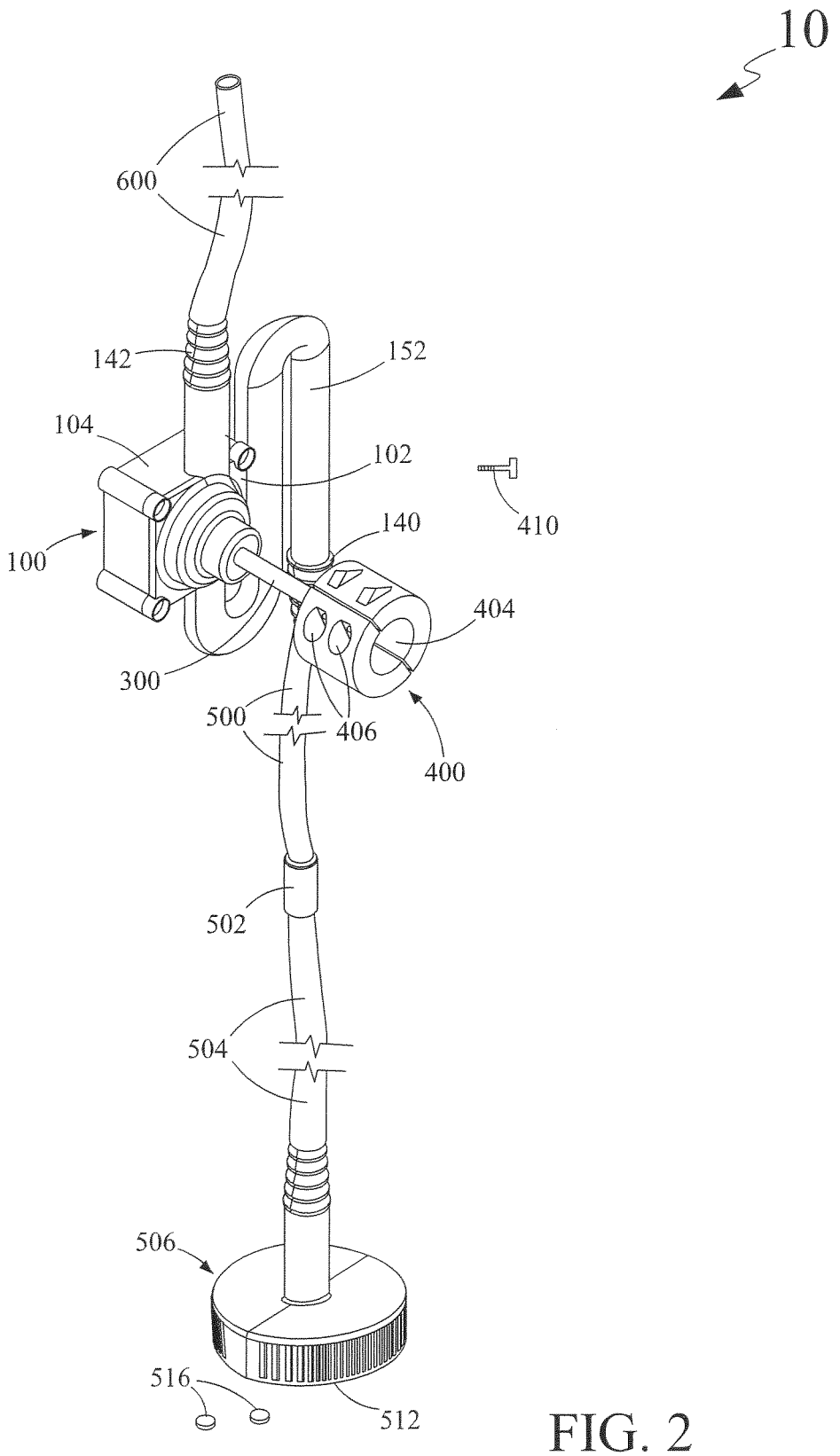
FIG. 2 is an assembled perspective view of the pump assembly of FIG. 1.

In the embodiment shown in FIG. 2, a first water trap portion 146 extends from first half casing 102 and a second water trap portion 144 extends from second half casing 120. The first water trap portion 146 and the second water trap portion 144 combine to form a water trap when the half casings 102 and 120 are secured to each other.

The pump assembly 10 may also include an outlet port 142 operatively coupled to the housing. In the embodiment shown in the drawings, a portion 142*a* of the first half casing 102 extends from an upper part of the first half casing to form one portion of outlet port 142, and a portion 142*b* of the second half casing 120 extends from an upper part of the second half casing 120 to form another portion of outlet port 142. These two portions 142*a* and 142*b* of the half casings 102 and 120 combine to form the outlet port 142 when the half casings 102 and 120 are secured to each other. Each of outlet port portions 142*a* and 142*b* may be molded, cast, or otherwise formed as an integral part of a respective one of the first half casing 102 and the second half casing 120. Alternatively, the outlet port 142 may be a separate component, which may be adapted to be coupled to one or both of the first half casing 102 and the second half casing 120 so as to enable fluid communication between an exterior of housing 100 and cavity 130. In a particular embodiment, the outlet port 142 is a separate component securely held between the first half casing 102 and the second half casing 120.

The pump assembly 10 may further include an impeller 200 adapted to be received in the housing 100. Specifically, the impeller 200 may be received in the cavity 130, between the first half casing 102 and the second half casing 120. The impeller 200 may be similar to a conventional impeller. Accordingly, the impeller 200 may include a body member 202 having a cylindrical shape, and a plurality of blade members 204 extending from the body member 202. Further, the impeller 200 may also include an opening 206 with a periphery shaped to receive therein a complementarily-shaped connecting portion 302 formed in a rod 300 (described below).

The pump assembly 10 may also include a rod 300 adapted to be operatively associated with the impeller 200. Specifically, the rod 300 may include a connecting portion 302 configured to conform to the shape of the opening 206 of the body member 202. Therefore, the connecting portion 302 may be inserted into the opening 206 for allowing the rod 300 to be connected to the impeller 200. Opening 206 and connecting portion 302 may have any of a variety of respective shapes that will ensure that the impeller 200 will rotate in association with the rod 300 when the rod member is attached or coupled to the impeller. Alternatively, the rod 300 may be connected to the impeller 200 by using other suitable means, such as adhesives or by use of a fastener. Otherwise, the rod 300 may be insert-molded to the impeller 200. The rod 300 may also include a portion 304 opposite to the connecting portion 302 for coupling the rod member to a complementarily-shaped portion of a connecting member 400 (described below) such that the rod member rotates in conjunction with the connecting member. Alternative forms of connection between the connecting member and the rod (for example, engagement between splines and corresponding grooves) may also be used to achieve the desired rotational coupling.

The pump assembly 10 may further include a connecting member 400. In one embodiment, the connecting member 400 may be cylindrical. However, the connecting member 400 may have any of a variety of other suitable shapes, such as an elongated oval shape or an elongated polygonal shape. In the embodiment shown in FIG. 1, connecting member 400 is divided into two separate portions which are attached to each other using screws, adhesives, or other suitable methods for forming the connecting member 400. The connecting member 400 may be operatively associated with the rod 300. Specifically, the connecting member 400 may include a first opening 402 adapted to receive therein the rod 300, for rotatably coupling the rod 300 to the connecting member 400. The connecting member 400 may also include a second opening 404 opposite to the first opening 402, and may include a plurality of threaded holes, such as a threaded holes 406, extending into outer surfaces 408 of the connecting member portions. Fasteners, such as Allen screws or set screws 410, 412, 414, and 416 may be received in the threaded holes 406 to secure the connecting member portions together. A bushing 306 and a seal 308 may be positioned along rod 300 to abut an interior surface of protrusion 108 to aid in preventing leakage from cavity 130 via hole 110.

The pump assembly 10 may also include an inlet pipe 500 adapted to be coupled to the inlet port 140, as shown in FIG. 2. The inlet pipe 500 may be adapted for channeling water into the housing 100 from a water tank of a swamp cooler. The pump assembly 10 may also include a check valve 502 operatively coupled to the inlet pipe 500, as shown in FIG. 2. The check valve 502 may allow a water movement from the water tank towards the inlet pipe 500 and may restrict a water movement from the inlet pipe 500 towards the water tank. In one embodiment, the check valve 502 is a ball check valve.

Further, the pump assembly 10 may include a connecting pipe 504 operatively coupled to the check valve 502, as shown in FIG. 2. Furthermore, the pump assembly 10 may also include a filter member 506 operatively coupled to the connecting pipe 504. The filter member 506 may include a filter connector 508, such as a barb adaptor, operatively coupled to the connecting pipe 504, as shown in FIG. 2. The filter member 506 may also include a filter screen 510 operatively coupled to the filter connector 508. The filter member 506 may aid in preventing debris from entering the inlet pipe 500 and housing 100 when water is drawn from the water tank.

Moreover, the pump assembly 10 may include a retaining means adapted to retain the filter member 506 in a fixed position on the water tank. In one embodiment, the retaining means may include a metal washer 512, a screw 514 adapted to attach the metal washer 512 to the filter screen 510, and a pair of magnets 516 adapted to be carried by the metal washer 512. The pair of magnets 516 may enable securement of the filter member 506 in the fixed position on the water tank, when the water tank is made of a suitable ferrous metal.

The pump assembly 10 of the present disclosure may also include an outlet pipe 600 operatively coupled to the outlet port 142. The outlet pipe 600 may enable channeling the water from the housing 100 to fibrous pads of the swamp cooler.

Referring now to FIG. 2, an assembled perspective view of the pump assembly 10 of FIG. 1 is shown. The pump assembly 10 may be assembled by first inserting (if necessary) the connecting portion 302 of the rod 300 into the opening 206 of the impeller 200. Thereafter, the impeller 200 may be received by the hollow portion of protruding portion 106 of the first half casing 102 by allowing the rod 300 to extend out of the hole 110 of the protruding portion 106. Specifically an end of the rod member 300 may be allowed to extend out of the first half casing 102.

Further, the second half casing 120 may be placed on the first half casing 102, such that, the opening formed in rounded flange 122 may align with the opening formed in rounded flange 112, the opening formed in rounded flange 128 may align with the opening formed in rounded flange 116, the opening formed in rounded flange 124 may align with the opening formed in rounded flange 114, and the opening formed in rounded flange 126 may align with a corresponding opening formed in a rounded flange (not shown) formed in a corner of first half casing 102, the view of which is obstructed by protrusion 108. Thereafter, the plurality of screws 132, 134, 136, and 138 may be received through the openings of the first half casing 102 and the second half casing 120 for coupling the first half casing 102 to the second half casing 120. Thereafter, the connecting member 400 may be attached to the rod 300. Finally, the inlet pipe 500 and the outlet pipe 600 (if formed separately from the housing) may be coupled to the inlet port 140 and the outlet port 142, respectively, for assembling the pump assembly 10.

The pump assembly 10 of the present disclosure may include various sealing members (not shown), such as rubber or plastic washers or gaskets, for ensuring air tight sealing between the first half casing 102 and the second half casing 120 when coupled to each other. Further, the pump assembly 10 may also include wire clamps or other suitable features (not shown) which may enable coupling and securement of the piping portions of the pump assembly 10 to other portions of the assembly pipe heads. For example, when an end portion of the inlet pipe 500 is joined to the inlet port 140, a wire clamp may be used for rigidly securing the pipe end portion to the inlet port 140.

Figure 3:
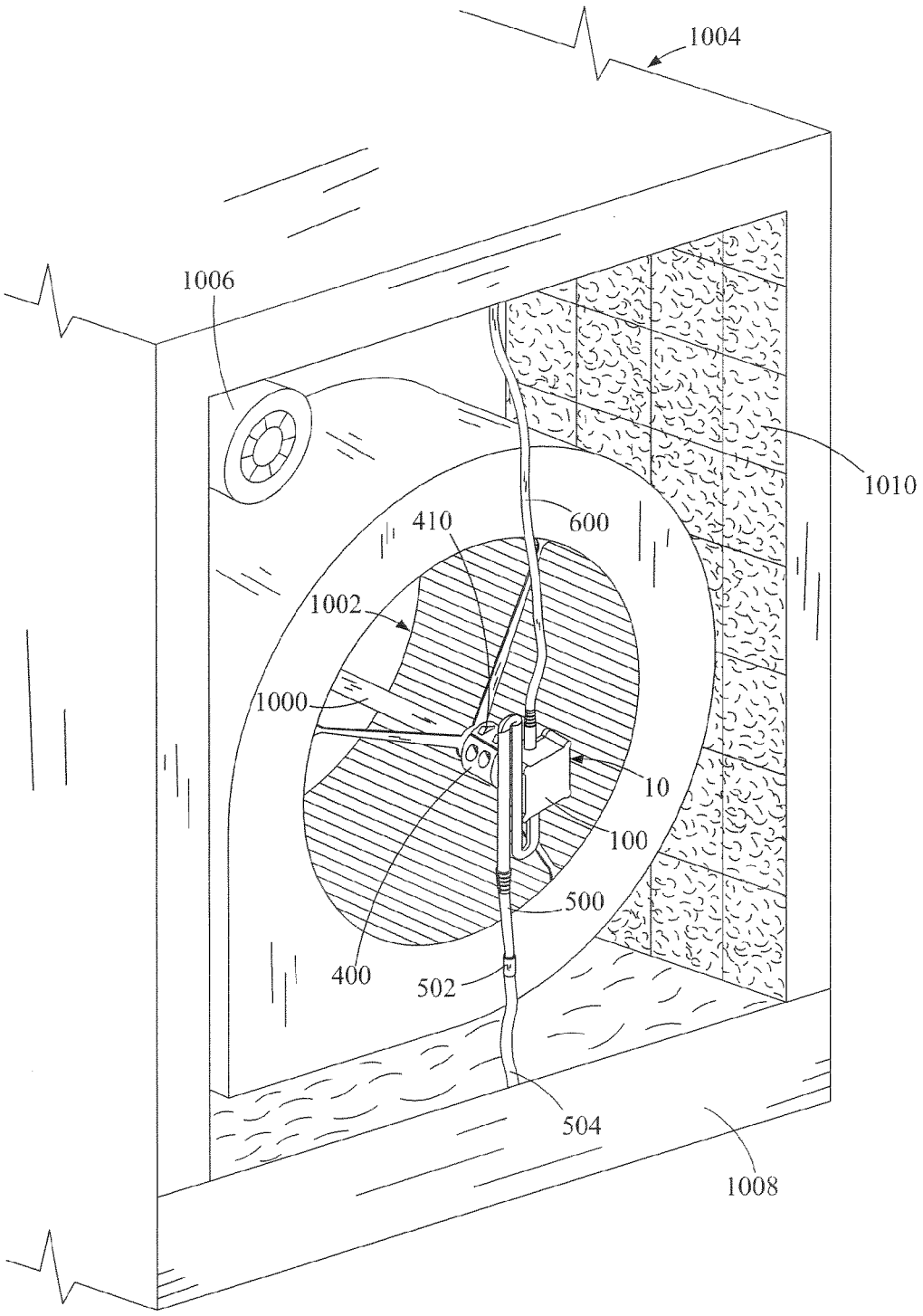
FIG. 3 is an environment in which the pump assembly of FIG. 2 may be utilized for circulating water in a swamp cooler.

Referring now to FIG. 3, in use, the pump assembly 10 may be mounted on a shaft 1000 of a fan assembly 1002 of a swamp cooler 1004. Specifically, the second slot 404 of the connecting member 400 (as shown in FIGS. 1 and 2) may receive a portion of the shaft 1000. Thereafter, the Allen screws 410, 412, 414, and 416 may be threadably received by the threaded holes 406 (as shown in FIGS. 1 and 2) of the connecting member 400 for rigidly mounting the connecting member 400 onto the shaft 1000 of the fan assembly 1002.

Additionally, the pump assembly 10 of the present disclosure may also include a mounting mechanism (not shown) adapted for mounting the housing 100 of the pump assembly 10 on at least a portion of the swamp cooler 1004 in proximity to the shaft 1000 of the fan assembly 1002. Specifically, the mounting arrangement may include a plurality of brackets and screws adapted for rigidly mounting the housing 100 in proximity to the shaft 1000. The mounting arrangement may be capable of firmly holding the housing 100 in a desired position when the shaft 1000 of the fan assembly 1002 rotates.

The shaft 1000 of the fan assembly 1002 may be rotated by a motor 1006 of the swamp cooler 1004 upon providing electrical power to the motor 1006. Further, upon rotation of the shaft 1000, the connecting member 400 may transmit a rotary motion of the shaft 1000 to the rod 300. Accordingly, the rotation of the shaft 1000 may rotate the impeller 200 received within the housing 100, and operatively associated with the rod 300. The rotation of the impeller 200 within the housing 100 may create a sufficient pressure within the housing 100 which may allow the inlet pipe 500 to draw water from a water tank 1008 of the swamp cooler 1004 and channel the water into the housing 100. The filter member 506, received in the water tank 1008, may filter the water prior to being drawn into the pump system. Thereafter, the filtered water may be received by the connecting pipe 504 which may be further channeled through the check valve 502 into the housing 100 through the inlet pipe 500.

The water received by the housing 100 may be received by the outlet pipe 600 for distributing the water to fibrous pads 1010 of the swamp cooler 1004. Specifically, the outlet pipe 600 may be attached to pipe branches (not shown), of the swamp cooler 1004, mounted above the fibrous pads 1010. Accordingly, the fibrous pads 1010 may receive the water delivered by the outlet pipe 600. Further, the water dripping from the fibrous pads 1010 may be collected in the water tank 1008. Therefore, the water from the water tank 1008 may be re-circulated in the swamp cooler 1004 with the help of pump assembly 10.

Based on the foregoing description of the present disclosure, a pump assembly, such as the pump assembly 10, may preclude a need of having a separate electrical supply for the operation thereof. Therefore, the pump assembly may preclude a need of having electric wires for the operation thereof. This eliminates possibilities of any hazards associated with the electrical wires incorporated into the pump system. Specifically, the use of the pump assembly of the present disclosure may eliminate fire hazards, and chances of receiving electric shocks, due to faulty electrical wires in the pumping system. Additionally, the use of the pump assembly of the present disclosure may lead to savings in money as separate electrical supply for the operation the pump assembly is not necessary. Therefore, the pump assembly of the present disclosure serves as an eco-friendly, affordable, and safe device which may be utilized in conjunction with swamp coolers.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A pump assembly for circulating water in a swamp cooler having a fan assembly associated with a shaft, the pump assembly comprising:

a housing having a cavity;

an impeller received in the cavity, the impeller being operatively connected to the shaft so as to transmit rotary motion of the shaft of the fan assembly to the impeller, and so as to secure an axis of rotation of the impeller in a coaxial relationship with an axis of rotation of the shaft of the fan assembly; and a rod operatively associated with the impeller; and a connecting member operatively associated with the rod, the connecting member structured to be operatively associated with the shaft of the fan assembly so as to transmit rotary motion of the shaft to the impeller, and the connecting member comprising a first slot adapted to threadably receive the rod, and a second slot adapted to receive the shaft of the fan assembly for allowing coupling of the connecting member to the shaft such that the connecting member rotates in conjunction with the shaft.

2. The pump assembly of claim 1, wherein the housing comprises:

a first half casing, a second half casing coupled to the first half casing for configuring the cavity therebetween, and wherein the pump assembly further comprises an inlet port coupled to the housing so as to enable fluid communication between an exterior of the housing and the cavity, and an outlet port coupled to the housing so as to enable fluid communication between an exterior of the housing and the cavity.

3. The pump assembly of claim 2, further comprising:

an inlet pipe adapted to be operatively coupled to the inlet port, the inlet pipe being adapted for channeling water into the housing from a water tank of the swamp cooler when the impeller rotates, and an outlet pipe adapted to be operatively coupled to the outlet port, the outlet pipe being adapted for channeling water from the housing.

4. The pump assembly of claim 3, further comprising a check valve adapted to be operatively coupled to the inlet pipe, the check valve being adapted for allowing a flow of water from the water tank towards the inlet pipe and restricting a flow of water from the inlet pipe towards the water tank.

5. The pump assembly of claim 1, wherein the connecting member is coupled to the shaft using a fastener.

6. The pump assembly of claim 1 further comprising a trap operatively coupled to an inlet of the housing and extending along a side of the housing.

7. The pump assembly of claim 1 wherein the connecting member is structured to operatively associate the rod with the shaft such that an axis of rotation of the rod is in a coaxial relationship with the axis of rotation of the shaft of the fan assembly.

8. A pump assembly for circulating water in a swamp cooler having a fan assembly associated with a shaft, the pump assembly comprising:

a housing having a cavity;

an impeller received in the cavity, and means for operatively coupling the impeller to the shaft so as to transmit rotary motion of the shaft of the fan assembly to the impeller, and so as to secure an axis of rotation of the impeller in a coaxial relationship with an axis of rotation of the shaft of the fan assembly, wherein the coupling means comprises a rod operatively associated with the impeller, said rod having a shaped portion; and a connecting member operatively associated with the rod, the connecting member structured to be operatively associated with the shaft of the fan assembly so as to transmit rotary motion of the shaft to the impeller, and the connecting member comprising a first portion complimentarily shaped to receive the shaped portion of said rod, and a second portion adapted to receive the shaft of the fan assembly for allowing coupling of the connecting member to the shaft such that the connecting member rotates in conjunction with tbe shaft.

* * * * *

UNITED STATES PATENT AND TRADEMARK OFFICE

CERTIFICATE OF CORRECTION

PATENT NO. : 8,556,595 B2
APPLICATION NO. : 12/762599
DATED : October 15, 2013
INVENTOR(S) : Armstrong It is certified that error appears in the above-identified patent and that said Letters Patent is hereby corrected as shown below:

In the Claims:

Column 7; Claim 1; Line 22; delete the word “threadably”.

Column 8; Claim 8; Line 42; delete “tbe” and insert --the--.

Signed and Sealed this
Twenty-fourth Day of December, 2013

Margaret A. Focarino

Margaret A. Focarino
*Commissioner for Patents of the United States Patent and Trademark Office*